US006840177B1

(12) United States Patent
Hatteland

(10) Patent No.: US 6,840,177 B1
(45) Date of Patent: Jan. 11, 2005

(54) FIREWORKS DEVICE

(75) Inventor: Jakob Hatteland, Nedre Vats (NO)

(73) Assignee: Jakob Hatteland Kjemi AS, Nedre Vats (NO)

( * ) Notice: Subject to any disclaimer, the term of this patent is extended or adjusted under 35 U.S.C. 154(b) by 112 days.

(21) Appl. No.: 10/130,531

(22) PCT Filed: Nov. 16, 2000

(86) PCT No.: PCT/NO00/00388

§ 371 (c)(1),
(2), (4) Date: May 17, 2002

(87) PCT Pub. No.: WO01/36899

PCT Pub. Date: May 25, 2001

(30) Foreign Application Priority Data

Nov. 19, 1999 (NO) ..... 19995702

(51) Int. Cl.[7] ..... F42B 4/00; F42B 4/04
(52) U.S. Cl. ..... 102/361; 102/335; 102/347
(58) Field of Search ..... 102/335–361

(56) References Cited

U.S. PATENT DOCUMENTS 4,706,568 A * 11/1987 Lundwall et al. ..... 102/513
4,934,273 A * 6/1990 Endriz ..... 102/336
5,102,131 A 4/1992 Remington ..... 273/586
5,222,798 A * 6/1993 Adams ..... 362/110
5,339,741 A * 8/1994 Craven et al. ..... 102/361
5,425,542 A 6/1995 Blackwood et al. ..... 273/416
5,481,979 A * 1/1996 Walder ..... 102/498
5,661,257 A * 8/1997 Nielson et al. ..... 102/334
5,725,445 A 3/1998 Kennedy et al. ..... 473/570
5,917,146 A 6/1999 Hiskey et al. ..... 149/36

FOREIGN PATENT DOCUMENTS

RU 237042 6/1969
RU 9947 5/1999

* cited by examiner

*Primary Examiner*—Michael J. Carone
*Assistant Examiner*—James S. Bergin
(74) *Attorney, Agent, or Firm*—Finnegan, Henderson, Farabow, Garrett & Dunner, L.L.P.

(57) ABSTRACT

A fireworks device, including a number of light effect devices as a replacement for traditional pyrotechnic stars. Each light effect device includes electrical/electronic light sources, preferably high-intensity light-emitting diodes, an energy-storage device and a control device. The light effect device for use in such a fireworks device can be used together with a fireworks system, a fireworks rocket and a ground firework in which the firework device is included.

18 Claims, 1 Drawing Sheet

FIREWORKS DEVICE

BACKGROUND OF THE INVENTION

The invention relates to a fireworks device, and especially a fireworks device wherein pyrotechnic stars are replaced by electrical/electronic light effect devices.

The invention also relates to a light effect device for use in fireworks, a fireworks system and a fireworks rocket in which the fireworks device is included.

Pyrotechnics is a field with traditions going back for many centuries. Even though technical developments have tended to produce more impressive, more precise, safer and to some extent more environmentally friendly fireworks, the basic principles are the same as in earlier times. Traditional fireworks, particularly aerial fireworks, comprise a pyrotechnic projectile which is fired into the air by means of a first charge, called the lifting charge, whereupon it is exploded by a second charge, called the booster charge. When the booster charge is fired; a number of pyrotechnic light effect devices, usually described as fireworks stars, are normally ignited and dispersed. These provide light and colours, usually creating an attractive kinetic pattern which forms the climax of the fireworks display. The timing for firing the two charges is traditionally controlled by means of a first fuse which provides the necessary time delay from lighting the fuse until firing the lifting charge, and a second fuse which provides a time delay from firing the lifting charge until firing the booster charge. In larger and more modern fireworks the first fuse has partly been replaced by electrical ignition devices.

The function of the pyrotechnic light effect devices (the stars) is to provide a relatively bright light of a given colour, colour composition or colour sequence, possibly with special extra effects, over a limited period. Normally a star of this kind consists of an internal core of glass or a metal such as lead or steel, plus one or more layers of chemical substances which on combustion provide the desired colour and effect, and on the outside an ignition layer to facilitate ignition of the star when the booster charge is fired.

In all known fireworks the star's production of light is based on combustion of a chemical substance. Such fireworks have a number of disadvantages. Amongst other things, the fireworks represent a major fire risk during use, since the falling stars burn at high temperatures and can set fire to objects on the ground or objects they meet on their way to the ground. The stars also constitute an explosion and fire risk during production, storage, transport and handling immediately preceding launching and use.

Furthermore, there is the risk that all the stars are not necessarily ignited when the booster charge is fired. This results in stars which are not ignited falling to the ground, and these objects constitute a fire and explosion risk for the future, which can be particularly dangerous in the hands of children. These undetonated remains also represent pollution of the environment, since the chemical substances in the stars can be poisonous or environmentally harmful in other ways. Correctly ignited stars also produce pollution of the area on the ground, as the star's core may contain harmful substances which are not burned, particularly when the core contains lead.

Additional problems are represented by discharges into the air during combustion of the stars. The smoke which is created during combustion is not only environmentally harmful, but is also detrimental to the visual effect of the fireworks. The formation of smoke causes the light effects from the firework and from other fireworks in the vicinity to be dimmed and obscured.

Another factor which reduces the visual effect of traditional fireworks is as follows: after the booster charge has been fired, each burning star moves in a path through the air. The motion and air resistance lead to a cooling of the star, particularly the part of the star which is located in front facing the air flow. Since the light from the star requires a high temperature, the cooling has the effect of reducing the light and thereby the visual effect of the fireworks.

The above-mentioned factors involving fire hazard and damage to the environment have resulted in the prohibition of the use of fireworks in a number of places, including city centres.

Traditional fireworks, moreover, occupy a relatively large amount of space, thus entailing high transport and storage costs.

A final problem with to-day's pyrotechnic firework stars is the risks involved in handling the chemical substances in the work environment during production of the stars.

In recent years there have been significant developments in the technology involved in electronic light sources, especially light-emitting diodes (also called light diodes or LED's). Thanks to this development, light-emitting diodes are produced to-day with substantially higher light intensity then previously. Moreover, the light-emitting diodes can be made with small dimensions, and they have a high degree of efficiency. Light-emitting diodes are therefore steadily gaining new areas of application. While light-emitting diodes were previously employed for low-level light indicators and display units, they are now being used in new fields where stringent demands are placed on visibility and intensity, for example as traffic lights, warning lights and brake lights for vehicles.

On account of the numerous drawbacks of traditional pyrotechnic stars in fireworks as mentioned above, there is clearly a need to provide fireworks, firework devices (projectiles) and light effect devices (stars) which are not encumbered by the said disadvantages, while at the same time being efficient and attractive as well as being inexpensive to produce.

There are previously known solutions which overcome some of the above-mentioned drawbacks.

U.S. Pat. No. 5,917,146 proposes reducing the problem of smoke formation which impedes the view and thereby the visual effect of the fireworks by means of a new, low-smoke chemical composition of the pyrotechnic stars.

U.S. Pat. No. 5,339,741 illustrates fireworks with reduced environmental discharge, which also provide precise firing and dispersal of firework stars. In this case the lifting charge is replaced with a compressed air-based launching device, and the projectile's booster charge is controlled by an electrical ignition device with electronic delay instead of a traditional fuse. A reduction is thereby achieved in the noise and discharge affecting the environment during launching, and great accuracy in the height calculated for the projectile when firing the booster charge. The firework stars dispersed from the projectile, however, are of the traditional, pyrotechnic type.

Flying or falling objects are also previously known, containing electronic light sources in the form of light-emitting diodes, an energy source and control/sensor devices.

U.S. Pat. No. 5,425,542 describes a flying projectile in the form of a dart, containing one or more light-emitting diodes, a battery and a switch device which is activated by relative movement between the point and the body of the dart.

U.S. Pat. No. 5,725,445 illustrates a ball containing light-emitting diodes, a flash circuit and a motion sensor.

The two above-mentioned publications have no application in the field of fireworks, and in principle are significantly different from the present invention.

U.S. Pat. No. 5,102,131 regards self-illuminated luminous playballs for nighttime play which may be either inflated or self-supporting and consist of various apparently ordinary looking balls with portable electric lighting assemblies or chemi-luminescent lights, including fireworks inside them. The playballs also comprises means for securing the illumination device inside the ball such that its centre of gravity coincides with that of the ball and on-off switching means.

A first object of the present invention is to provide a firework device which is not encumbered by the previously mentioned disadvantages.

A second object of the invention is to provide a light effect device for use in fireworks, which is not encumbered by the said disadvantages.

A third and fourth object of the invention is to provide a firework system and a firework rocket which are not encumbered by the said disadvantages.

SUMMARY OF THE INVENTION

These objects are achieved by a fireworks device, comprising a number of light effect devices and a drive device arranged to drive the light effect devices apart, characterized in that each light effect device comprises at least one electrical/electronic light source, an energy-storage device and a control device for controlling the light sources.

BRIEF DESCRIPTION OF THE DRAWINGS

The invention will now be described in more detail by means of preferred embodiments, with reference to the drawings, and by a description of some possible variation and alternatives.

DETAILED DESCRIPTION OF THE INVENTION

Figure 1A:
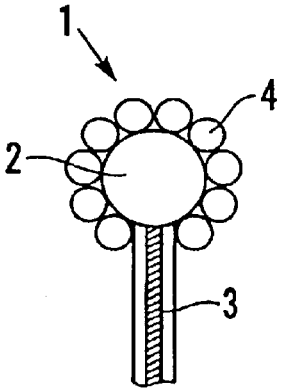
Fig. 1a Prior Art
FIGS. 1*a*–1*b* illustrate the construction of a fireworks device with traditional, pyrotechnic firework stars.

In FIG. 1*a* an illustration is given of how a fireworks device, or more specifically a fireworks projectile, can be constructed according to the prior art. The projectile 1 consists of a booster charge 2, a fuse 3 and a number of firework stars 4. When it is used the projectile 1 is fired into the air by a lifting charge (not illustrated). The lifting charge may be installed in and accompany the firework, if the firework is of the rocket type, or the lifting charge may be installed in a launching device on the ground. In both cases the fuse 3 is lit during launching, and after a period of time, which is determined by the fuse's burning time, the booster charge 2 is fired. This firing causes preferably all the stars 4 to be ignited, and they are scattered at an exit velocity and direction before falling to the ground.

Figure 1B:
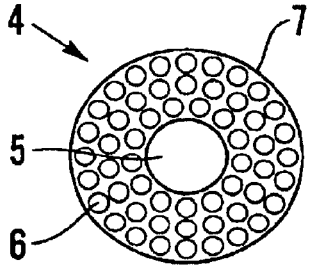
Fig. 1b Prior Art

FIG. 1*b* is a principle illustration of the construction of a traditional pyrotechnic firework star. The star 4 consists of a core 5 of glass or metal, e.g. lead or iron. In addition to pure production considerations, the task of the core is to give the star sufficient mass to enable it to achieve a large enough amount of kinetic energy when the booster charge is fired to attain the desired exit velocity, and to prevent it from being braked too quickly by the air resistance. The core is covered by one or more layers of chemical, pyrotechnic compounds, for example in the form of particles 6 held together by a binding agent, where the compounds provide specific light or colour effects during ignition and combustion. On the outside there is provided an ignition layer 7 to facilitate the ignition of the star when the booster charge 2 is fired.

Figure 2A:
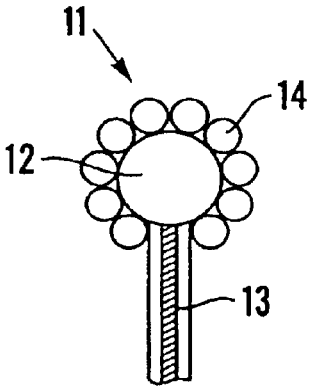
FIGS. 2*a*–2*b* illustrate the construction of a fireworks device with electronic light effect devices according to the invention.

FIG. 2*a* illustrates a fireworks device 11 according to the invention, in the form of a fireworks projectile. In this case, however, the pyrotechnic stars 4 are replaced with electronic light effect devices or electronic stars 14 according to the invention. The electronic stars 14 are installed around a drive device 12, which is preferably a booster charge consisting of an explosive material such as, for example, black powder, and which is equipped with an ignition device 13 in the form of a fuse. The object of the drive device 12 is to drive the electronic stars 14 apart. As an alternative the drive device 12 may be a non-explosive device where another form of potential energy is stored for driving the stars apart, for example in the form of air under pressure.

In a preferred embodiment the firework device 11 is fired into the air in the normal manner by means of a non-illustrated lifting charge, installed in a launching device. When the lifting charge is fired, the ignition device 13 in the form of a fuse is ignited. The fuse thereby provides a time delay, with the result that the burning time of the fuse is decisive for the time for firing the drive device 12 in the form of a booster charge. This firing causes the electronic stars 14 to be scattered at an exit velocity and direction before falling to the ground. The electronic stars 14 are not ignited, as was the case with the pyrotechnic stars, but they are activated by other means, which will be described later, by control or sensor devices contained in each electronic star 14. The placing of the electronic stars 14 around the booster charge and the individual star's mass and external shape can be instrumental in determining each star's exit velocity, direction and possible rotation. These factors can thereby contribute to the total appearance of the fireworks display.

As an alternative to having the lifting charge installed in a launching device, the firework may be composed of a rocket, where the lifting charge is installed in a part, especially a casing, which accompanies the fireworks device 11.

In a further alternative the firework may only have a booster charge, and no lifting charge.

Figure 2B:
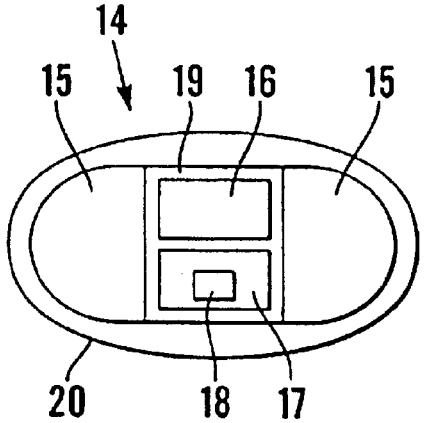

Instead of using an explosive/pyrotechnic lifting charge, other known per se means may be employed to fire the fireworks device 11 as a projectile up to a certain height before detonation of the booster charge. One possibility is to replace the lifting charge with a compressed air device installed in a launching device, as is known from U.S. Pat. No. 5,339,741 amongst others. In this case the ignition device 13 will also not be in the form of a fuse, but of an electrical ignition device, which is preferably electronically delayed, and which is preferably activated by the air-driven launch. FIG. 2*b* is a schematic illustration of the principle construction of an electronic light effect device or fireworks star according to the invention. The light effect device or electronic star 14 consists of a number of electrical/electronic light sources 15, an energy-storage device 16 and a control device 17.

The electrical/electronic light sources 15 are preferably high-intensity light-emitting diodes. There are various types of light-emitting diodes which provide light of high intensity and optional colour. For example, the light-emitting diodes may be of the AlInGaP type (Aluminum Indium Gallium Phosphide). Among alternative types may be mentioned AlGaAs (Aluminum Gallium Arsenic) and GaN (Gallium Nitride) light-emitting diodes. The choice of a suitable type of light-emitting diode, or other possible suitable electrical/electronic light source is a matter for assessment by a person skilled in the art.

The electronic star 14 comprises at least one light source 15, but it will preferably contain a larger number of light sources 15 to enable the electronic star 14 to be clearly visible from several angles. For example, the electronic star may contain six light-emitting diodes, each mounted with its primary light emitting axis in perpendicular and opposite directions. The electronic star 14 may further contain light sources 15 of different colours, with the same colours in all directions or specific colours in only some directions. The light-emitting diodes may be of a type which can emit several colours. The light-emitting diodes may have a field of emission in the form of a solid angle area where the light is emitted with a particularly high intensity. The extent of this solid angle may be a factor which is taken into consideration when choosing the number of light-emitting diodes with which each electronic star 14 has to be provided.

If the light sources 15 comprise light-emitting diodes, they should also comprise any necessary resistances for restricting the current through them. When using light-emitting diodes for fireworks purposes it is not necessary to make the same allowances as otherwise have to be made for the danger of overloading the light-emitting diodes, when reliability and durability are important considerations. When they are used in fireworks the current through the diode can be overriden far beyond the nominal value in order thereby to generate further light intensity. The light-emitting diodes should normally be lit only for a period of the order of up to 30 seconds, and normally 1–3 seconds, and the lifetime does not need to exceed this operating time. To find an optimal value for the extent of overriding, with regard to the total amount of energy consumed, intensity achieved and required operating time, is a matter of assessment for a person skilled in the art.

The energy-storage device 16 can emit electrical energy in sufficient quantities to supply the star electronic 14 with electric power for a sufficiently long period of time. Most of the energy has to be supplied to the light sources 15, but the energy-storage device 16 also has to supply the control device 17, possibly including the sensor device 18, with electric current and voltage. In a preferred embodiment the energy-storage device 16 is a chemical-electrical storage element in the form of a microbattery, for example of the lithium type. The microbattery is preferably of a type which can be manufactured integrated in a semiconductor chip. The energy-storage device 16 may be a disposable battery or of the chargeable type, for example in the form of a condenser. In this case the energy-storage device 16 must also be equipped with means for charging. In this case the charging must be carried out before the need for electrical energy to the firework star arises. The charging may be performed by induction, where the complete firework device is installed in a varying electromagnetic field before launching, thus charging all the energy-storage devices 16. Alternatively, kinetic energy during the launching or firing of the booster charge may be utilised for charging the energy-storage devices 16.

In its simplest conceivable form the control device 17 will be a switch device which at a suitable time connects the energy-storage device 16 to the light sources 15.

In a preferred embodiment the control device 17 comprises one or more sensor devices 18 for detection of external events which will activate or deactivate one or more of the light sources 15 in the electronic star. The control device 17 in this case may also consist of an electronic circuit which controls the various light-emitting diodes, and where the control is influenced by the sensor devices 18. The control is preferably arranged in such a manner that at least some light sources 15 are ignited as a response to the firing of the booster charge.

In a more comprehensive form the control device 17 is composed of one or more sensor devices 18, a digital processor unit which also includes input circuits for the sensor devices 18, drive circuits for controlling the light sources 15 and a memory with a program which enables the control device 17 to control the light sources 15 individually or in groups according to a specific sequence, in order thereby to produce effects such as flashing and changing colours. The control device 17, including the sensor devices 18, is advantageously integrated in one semiconductor chip.

The object of a sensor device 18 as mentioned above is to detect external events which will or may cause an activation or deactivation of the light sources 15 in the electronic star 14. Such external events are primarily composed of the firing of the booster charge which is generally followed by ignition of the electronic star 14. In a preferred embodiment the sensor devices 18 consist of an optical detector which detects the flash when the booster charge is fired. Alternatively, the sensor device 18 may be a temperature sensor which detects a heat increase as a result of the firing of the booster charge. The sensor device 18 may be a pressure, motion or acceleration sensor which can detect the firing of the booster charge or physical factors associated with the fireworks device 11 reaching its maximum height. A further alternative is that the sensor device 18 comprises a receiver which is sensitive to an encoded or uncoded electromagnetic wave signal, for example radio waves broadcast from a transmitter on the ground, or light waves (visible, infrared or ultraviolet light) with specific characteristics. In such a case it is possible to achieve central and absolutely precise control of the firework effects from the ground, which can be particularly advantageous in connection with synchronisation of the fireworks with specific times or external events, e.g. on a stage. The sensor device 18 may also consist of a combination of several of the above.

In order to achieve a sufficiently compact construction, thus enabling the invention to be used in practice, it is an advantage to place all of the star's components on one board or on one chip 19. With modern electronic production technology it is quite possible to manufacture an electronic star 14 which contains the necessary components as mentioned above, and achieve a suitable mass and volume. Light-sources 15, the energy-storage device 16 and the control device 17 and possibly a sensor device 18 may be placed on one and the same semiconductor chip 19, thereby bringing the production costs for a an electronic star 14 down to a cost-effective and competitive level. It is thus also practicable to assemble a suitable number of these electronic stars 14 together with a booster charge, thus permitting the construction of an efficient projectile, i.e., a fireworks device 11 according to the invention.

In a preferred embodiment the light effect device or electronic star 14 is equipped with an encapsulation 20 of glass or plastic. The encapsulation 20 will serve both as a protection against the stress from the booster charge when it is fired, and as an external shell with a shape which can provide the star with the desired aerodynamic properties or control properties when it is in free fall. The encapsulation 20 may be designed in such a manner that the star falls more quickly or more slowly, or it can be caused to rotate if this is desirable.

A fireworks device 11 employed as a projectile, in combination with a launching device which contains a lifting device, for example a lifting charge, represents a fireworks system according to the invention.

A fireworks device 11 installed in a unit, for example a casing, together with a lifting charge, represents a fireworks rocket according to the invention.

A fireworks device 11, provided without a lifting charge, represents a ground firework according to the invention. In this case the lifting charge is fired from ground level, and preferably from a so-called mine in which the ground firework is installed. When the booster charge is fired the electronic stars 14 will be driven apart, substantially directed upwards, thus forming a fountain of bright, falling electronic stars 14.

By using fireworks devices 11, light effect devices or electronic stars 14, fireworks systems or fireworks rockets according to the invention, many of the existing drawbacks of traditional fireworks will be eliminated. The risk of fire and the production of smoke during use will be considerably reduced, and the fireworks can thereby be used in entirely different environments from before, both in central urban areas and even indoors. Thus the invention has an obvious area of application in association, amongst other things, with stagecraft for theatre, film and musical performances.

Where the fireworks are equipped with a non-explosive-based lifting charge, in addition to which the drive device 12 is not an explosive booster charge, according to the invention it will be possible to obtain an entirely explosive-free firework, which can be used completely without risk of fire or explosion at locations where fireworks otherwise would be hazardous, for example indoors.

Even though in the above description special mention has been made of the use of high-intensity light-emitting diodes, such as AlInGaP light-emitting diodes, other types of electrical/electronic light sources, including light-emitting diodes of a different composition or method of production, both existing and future variants, ;rill also fall within the scope of the present invention.

What is claimed is:

1. A fireworks device, comprising a number of light effect devices and a drive device arranged to drive the light effect devices apart, wherein each light effect device comprises at least one electrical/electronic light source, an energy-storage device and a control device for controlling the at least one electrical/electronic light source and wherein the at least one electrical/electronic light source, the energy-storage device and the control device of each light effective device are designed as components on one and the same semiconductor chip.

2. The fireworks device according to claim 1, wherein the at least one electrical/electronic light source comprises a light-emitting diode.

3. The fireworks device according to claim 1, wherein the drive device comprises an explosive booster charge equipped with a fuse or electrical ignition device.

4. A fireworks rocket comprising a lifting charge and a fireworks device according to claim 3.

5. A ground firework comprising a fireworks device according to claim 3.

6. The fireworks device according to claim 1, wherein the energy-storage device comprises a microbattery.

7. The fireworks device according to claim 1, wherein the control device comprises one or more sensor devices which are arranged to detect external events which may cause an activation or deactivation of the at least one electrical/electronic light source.

8. The fireworks device according to claim 7, wherein the one or more sensor devices are sensitive to one or more of the factors light, temperature, pressure, acceleration and radio waves.

9. The fireworks device according to claim 7, wherein the one or more sensor devices are arranged to detect the light, temperature or pressure which arise when the drive device is activated.

10. The fireworks device according to claim 1, wherein the control device is arranged to generate a sequence of signals for controlling individual light sources or groups of light sources.

11. A fireworks system, comprising a launching device which contains a lifting device, and a launchable projectile in the form of a fireworks device according to claim 1.

12. A light effect device, comprising at least one electrical/electronic light source, an energy-storage device and a control device for controlling the at least one electrical/electronic light source, wherein the control device is arranged to give a response to the activation of a booster device in a firework and wherein the at least one light source, the energy-storage device and the control device are designed as components on one and the same semiconductor chip.

13. The light effect device according to claim 12, wherein the at least one electrical/electronic light source comprises a light-emitting diode.

14. The light effect device according to claim 12, wherein the energy-storage device comprises a microbattery.

15. The light effect device according to claim 12, wherein the control device comprises one or more sensor devices which are arranged to detect external events which may cause an activation or deactivation of the at least one electrical/electronic light source.

16. The light effect device according to claim 15, wherein the one or more sensor devices are sensitive to one or more of the factors light, temperature, pressure, acceleration and radio waves.

17. The light effect device according to claim 15, wherein the one or more sensor devices are arranged to detect the light, temperature or pressure which arise when the booster device is activated in the firework.

18. The light effect device according to claim 12, wherein the control device is arranged to generate a sequence of signals for controlling individual light sources or groups of light sources.

* * * * *